US011927081B2

(12) United States Patent
Yee et al.

(10) Patent No.: US 11,927,081 B2
(45) Date of Patent: Mar. 12, 2024

(54) LINER RUNNING TOOL, METHOD, AND SYSTEM

(71) Applicants: Chee Kong Yee, Katy, TX (US); Andy Tom, Houston, TX (US)

(72) Inventors: Chee Kong Yee, Katy, TX (US); Andy Tom, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/870,002

(22) Filed: Jul. 21, 2022

(65) Prior Publication Data

US 2024/0026759 A1 Jan. 25, 2024

(51) Int. Cl.
*E21B 43/10* (2006.01)

(52) U.S. Cl.
CPC ..... *E21B 43/10* (2013.01)

(58) Field of Classification Search
CPC ..... E21B 43/10
See application file for complete search history.

(56) References Cited

U.S. PATENT DOCUMENTS

| | | | | |
|---|---|---|---|---|
| 3,863,715 | A * | 2/1975 | Yonker | E21B 23/06 166/217 |
| 2005/0126775 | A1* | 6/2005 | Van Nguy | E21B 17/06 166/125 |
| 2016/0230478 | A1* | 8/2016 | Dietz | E21B 17/06 |
| 2017/0096882 | A1* | 4/2017 | Patterson | E21B 33/04 |
| 2018/0347323 | A1* | 12/2018 | Kohn | E21B 43/10 |

* cited by examiner

*Primary Examiner* — Taras P Bemko
(74) *Attorney, Agent, or Firm* — CANTOR COLBURN LLP

(57) ABSTRACT

A running tool which includes a mandrel, a thread engager disposed upon the mandrel, a support supporting the thread engager in a first position and unsupporting the thread engager in a second position, and a torque dog sub including a torque dog, a lock dog, and lock dog sleeve disposed on the mandrel. A liner system which includes a liner system component, a running tool engaged with the liner component. A borehole system including a borehole in a subsurface formation, and a liner system in the borehole. A method for releasing a liner including pressuring up on the running tool, shifting the lock dog sleeve, and slacking weight to shift the support. A method for releasing a liner including applying neutral set down weight to the running tool, rotating the support, slacking weight to shift the support, and moving the tool out of engagement with the liner.

17 Claims, 13 Drawing Sheets

LINER RUNNING TOOL, METHOD, AND SYSTEM

BACKGROUND

In the resource recovery and fluid sequestration industries, running liners is commonplace. Running tools exist today but as boreholes get longer and more tortuous, running tools can sometimes be less than adequate for the task. The art is always receptive to innovation that improve the ability to run liners to depth.

SUMMARY

An embodiment of a running tool including a mandrel, a thread engager disposed upon the mandrel, a support supporting the thread engager in a first position and unsupporting the thread engager in a second position, and a torque dog sub including a torque dog, a lock dog, and lock dog sleeve disposed on the mandrel.

An embodiment of a liner system including a liner system component, a running tool engaged with the liner component.

An embodiment of a borehole system including a borehole in a subsurface formation, and a liner system in the borehole.

An embodiment of a method for releasing a liner including pressuring up on the running tool, shifting the lock dog sleeve, and slacking weight to shift the support.

An embodiment of a method for releasing a liner including applying neutral set down weight to the running tool, rotating the support, slacking weight to shift the support, and moving the tool out of engagement with the liner.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
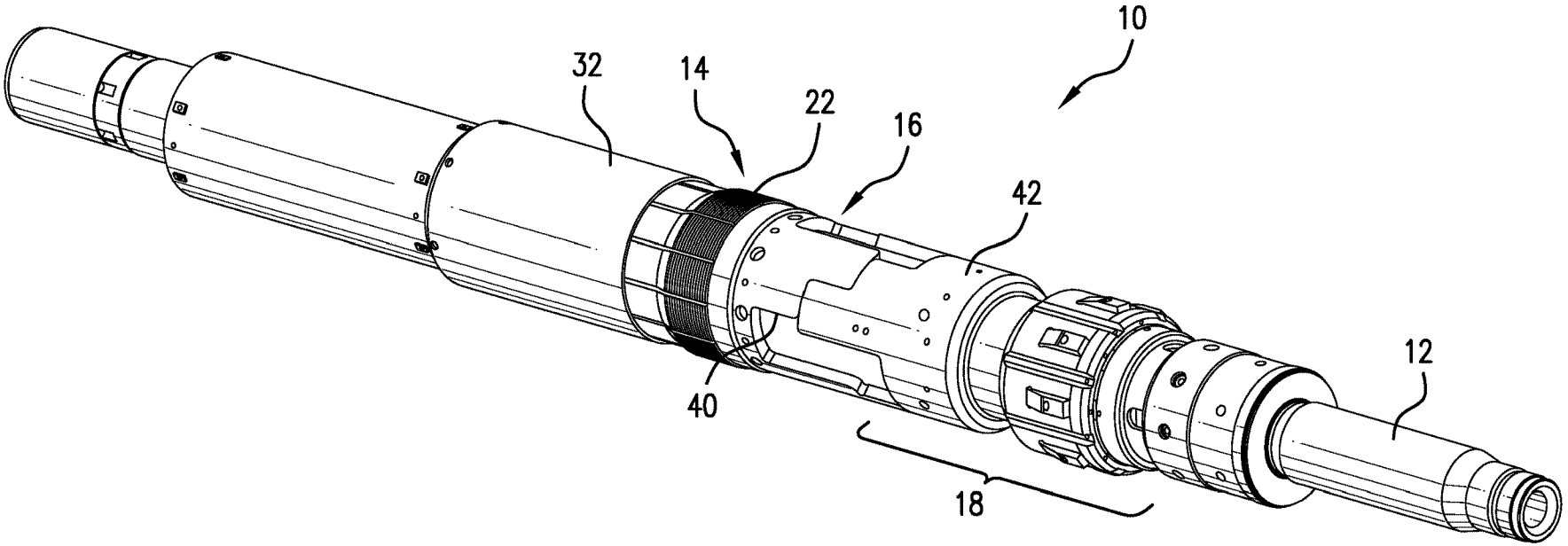
FIG. 1 is a perspective view of a running tool as disclosed herein.
Figure 2:
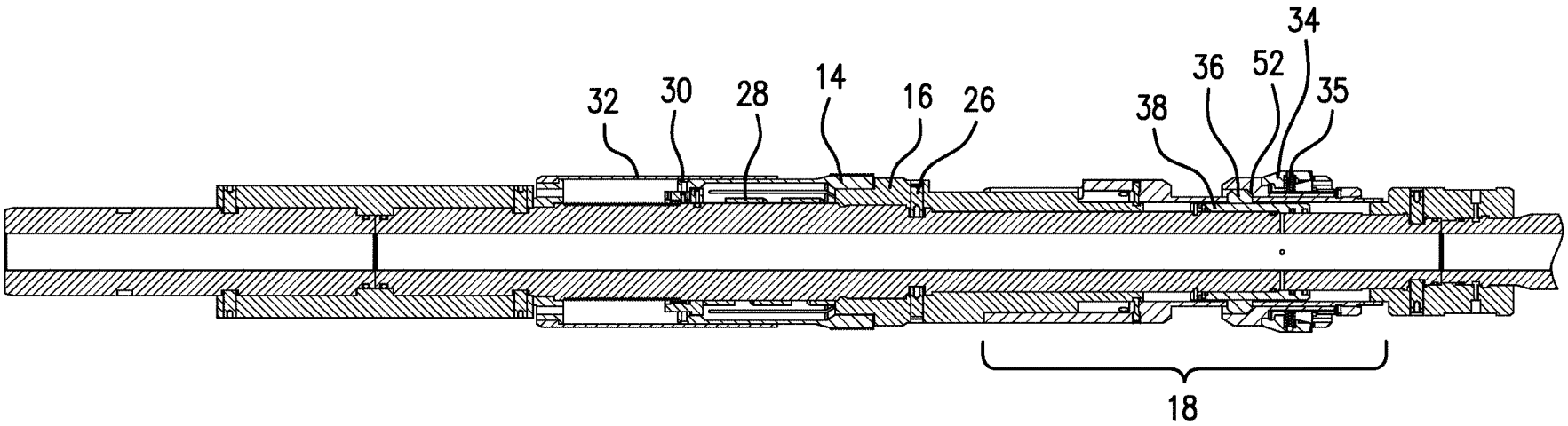
FIG. 2 is a longitudinal section view of the tool of FIG. 1.
Figure 3:
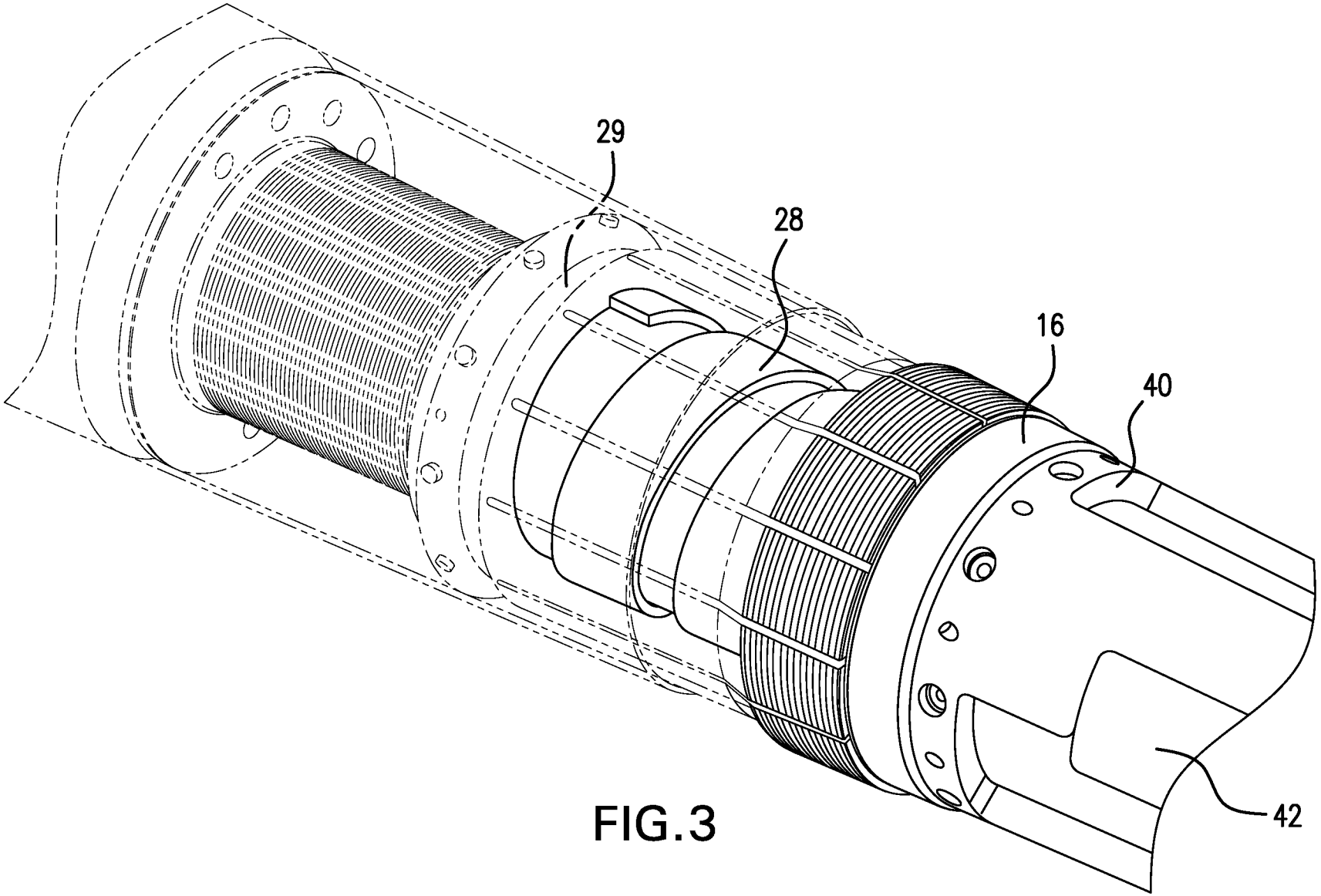
FIG. 3 is a partial transparent view of a portion of the tool f FIG. 1.
Figure 5:
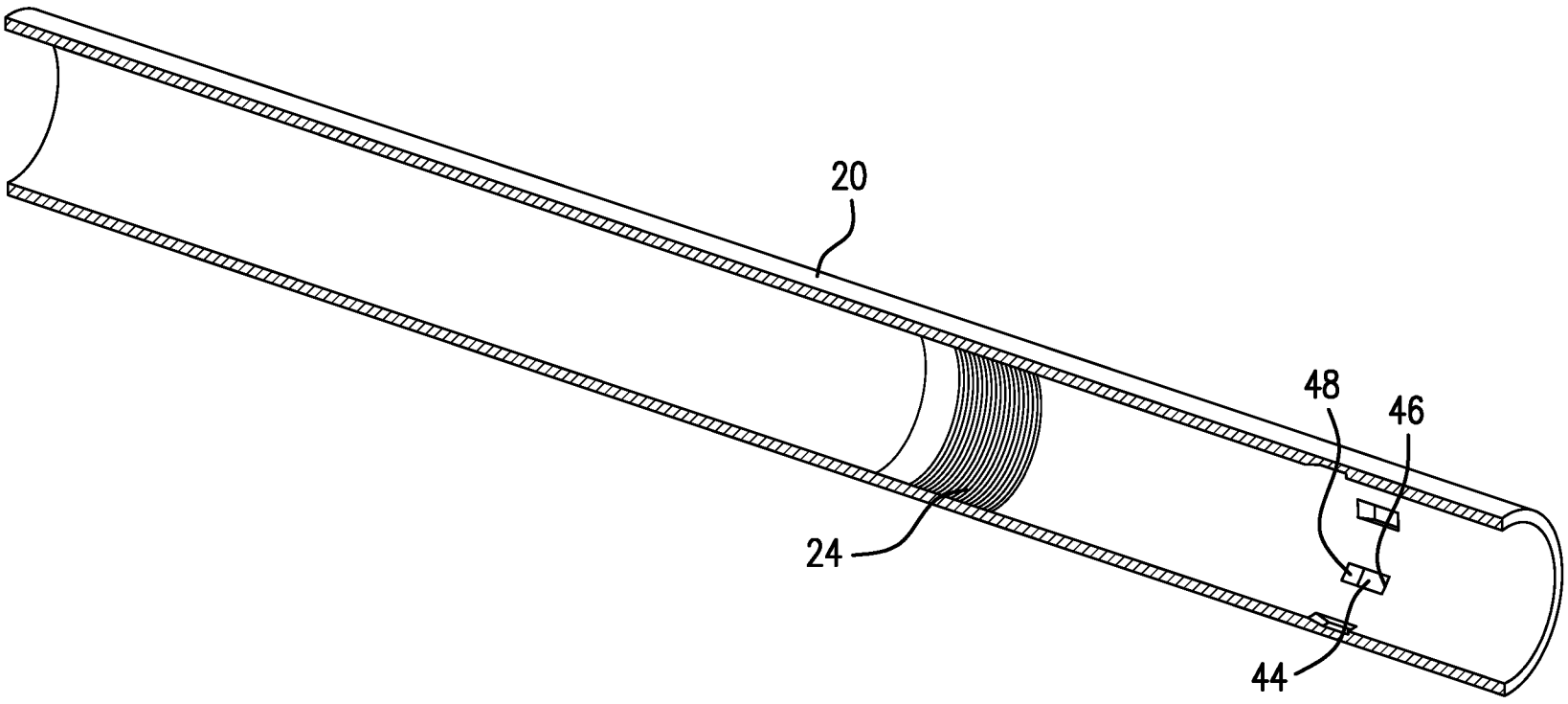
FIG. 5 is a perspective sectional view of a tubular member that may be a part of a liner hanger, setting tubular, liner, etc. illustrating engagement threads and torque dog recesses.
Figure 6:
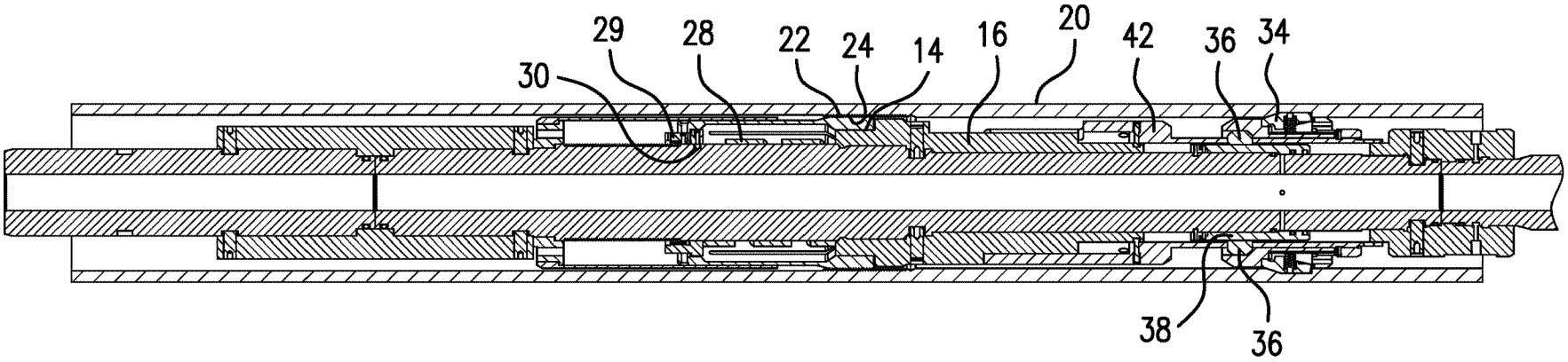
FIG. 6 is a sectional of the tool of FIG. 1 within the tubular of FIG. 5.

Referring to FIGS. 1 and 2, a running tool 10 is illustrated. The tool 10 comprises a mandrel 12 having a thread engager 14 disposed thereon, a support 16 disposed thereon and a torque dog sub 18 disposed thereon. The three components work together to, once engaged with a tubular 20 (see FIGS. 5 and 6), hold the weight of that tubular (and anything connected thereto) and enable the imposition of torque on the tubular. Large loads and input torque facilitate running of liners and similar into boreholes including large deviations horizontal segments and tight spots.

The thread engager 14 is configured as a collet that may be neutrally biased or may have a directional bias such as a radially inward bias. The thread engager 14 further includes a thread 22 that is configured to engage with a thread 24 of the tubular 20. Engagement of thread 22 with thread 24 enables weight bearing support of the tubular 20 through the tool 10. The thread engager 14 is supported in the engaged or engagable position (while or before, respectively being threaded into the tubular 20) by the support 16. The action of support and position of the tool 10 associated therewith is easily appreciated from FIG. 2. It will also be appreciated that the support 16 is threaded to the mandrel 12 and is pinned to the mandrel 12 with pin 26 to prevent relative rotation between the support 16 and the mandrel 12. The support 16 accordingly moves with the mandrel 12. In the position illustrated in FIG. 2, the threads 22 and 24 will remain engaged. Upon movement of the mandrel in a downhole direction (right of the Figure), the thread engager 14 will become unsupported and will either move radially inwardly out of engagement with the thread 24 due to its own radially inward bias or will be moved radially inwardly by force. This will become better understood below with reference to FIGS. 7A-7D and 9A-9D discussed hereunder but is raised here in order to introduce a biaser 28 (in an embodiments a compression spring held in place with a body lock ring 29) whose function it is to move the thread engager 14 leftwardly of the figure when a release member 30 (shear pin, detent, spring-based releaser, etc.) is released. The movement causes the thread engager 14 to contact a protector sleeve 32 that forces the engager 14 radially inwardly and out of engagement with thread 24.

The torque dog sub 18 is disposed about the mandrel 12 adjacent the support 16. The torque dog sub 18 includes a torque dog 34 (more than one is contemplated), a lock dog 36 (more than one is contemplated), and lock dog sleeve 38. The lock dog sleeve 38 is a hydraulically operated sleeve that responds to a hydraulic pressure increase in an inside diameter of the mandrel 12. Pressure therein may be increased due to the dropping of a plug, or the seating of a cement plug following a cement operation, etc. A mechanical release of tool 10 is provided for through the use of a rotational drive and longitudinal movement profile 40 at the outside surface of the support 16 and on an outside surface of a profile portion 42 of the torque dog sub 18. This may be used as a contingency release if the hydraulic release fails, or can be simply selected since both the hydraulic operation and the mechanical operation result in release of the tubular 20.

The torque dog 34 is intended to be received in a recess 44 of the tubular 20 when the tool 10 is engaged in the tubular 20. This allows for torque transfer from the tool 10 to the tubular 20 and also acts as a nogo for the tool 10 since a downhole end of recess 44 is a shoulder 46. The uphole end of recess 44 is however a chamfer 48 to allow an uphole pull to disengage the torque dog 34 from the recess 44. It will be appreciated that the torque dog 34 is mounted on a spring member 35 that allows for its deflection to be pulled out of recess 44 on overpull.

Figure 4:
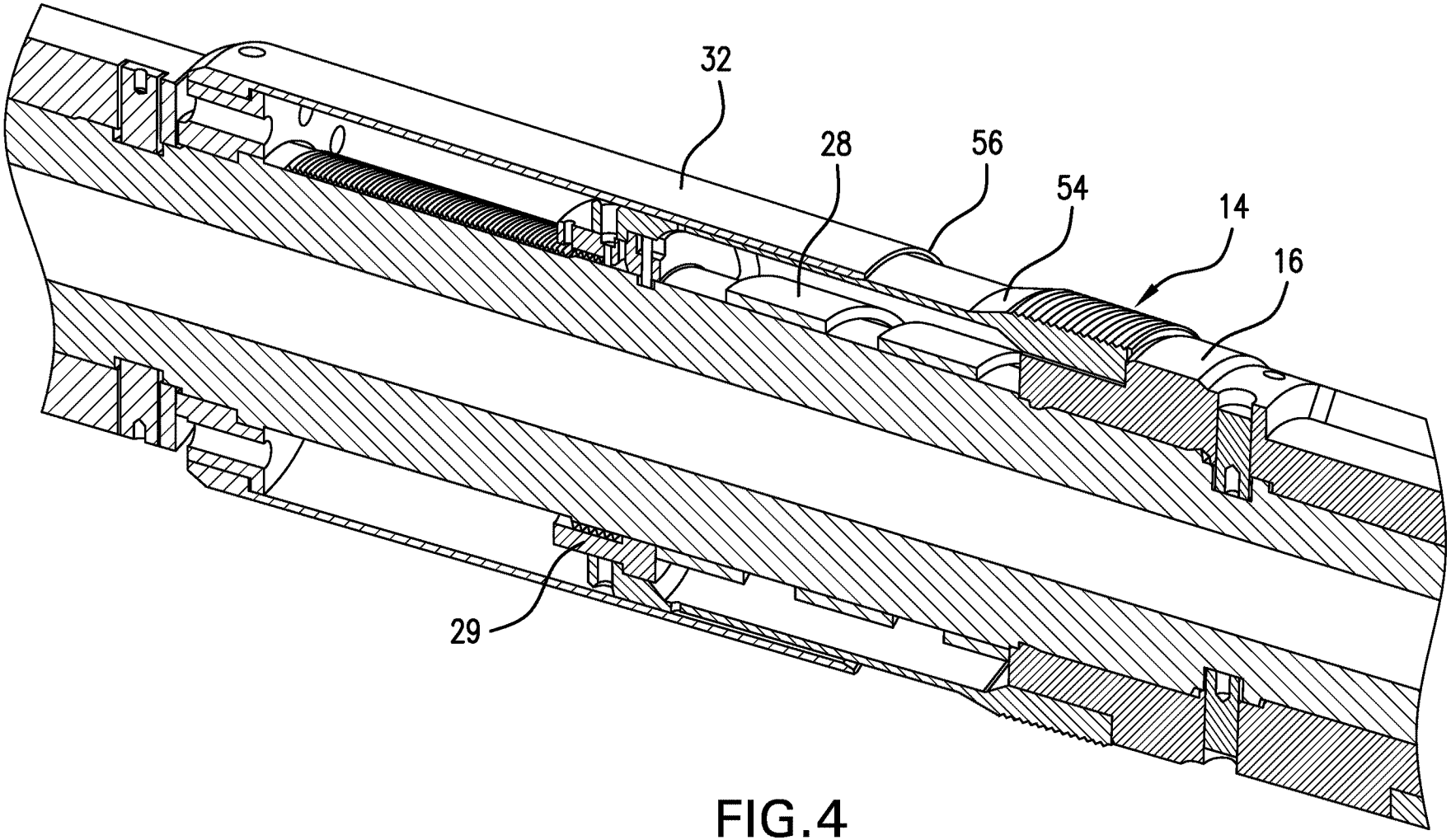
FIG. 4 is a perspective sectional view of the same portion of the tool as FIG. 3.
Figure 7A:
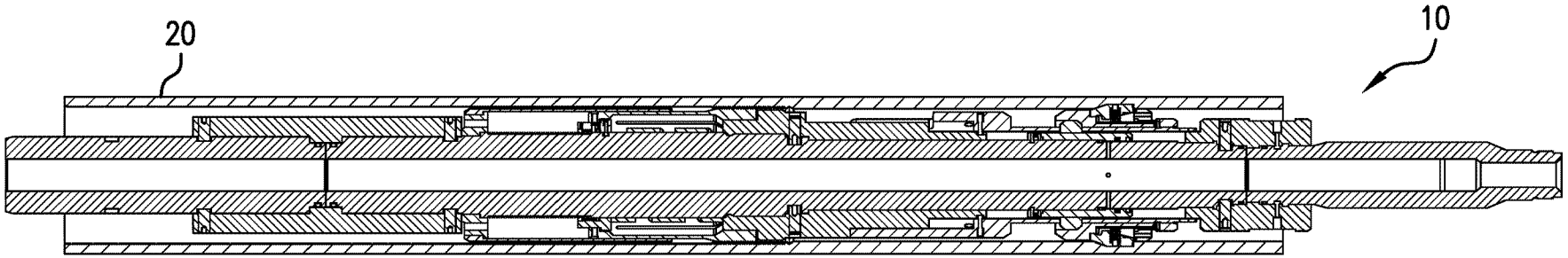
FIGS. 7A-7D are sequential views of the hydraulic release of the tool.
Figure 7B:
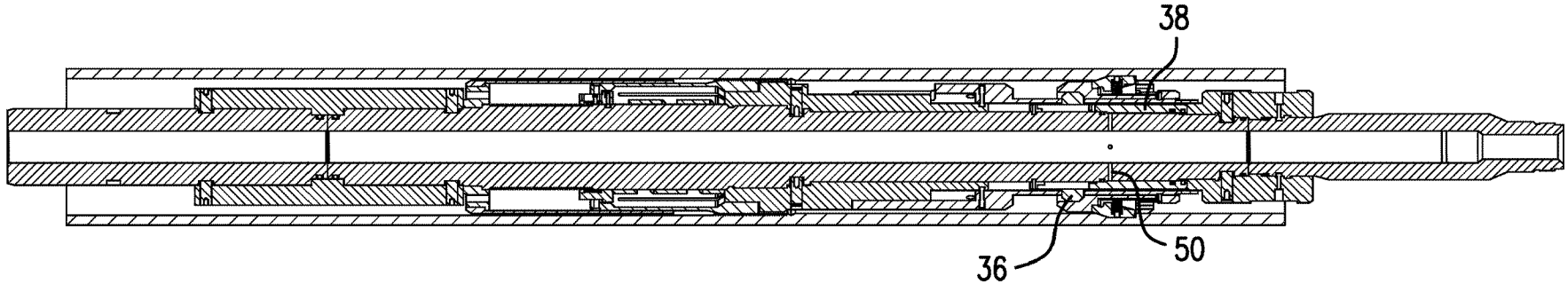
Figure 7C:
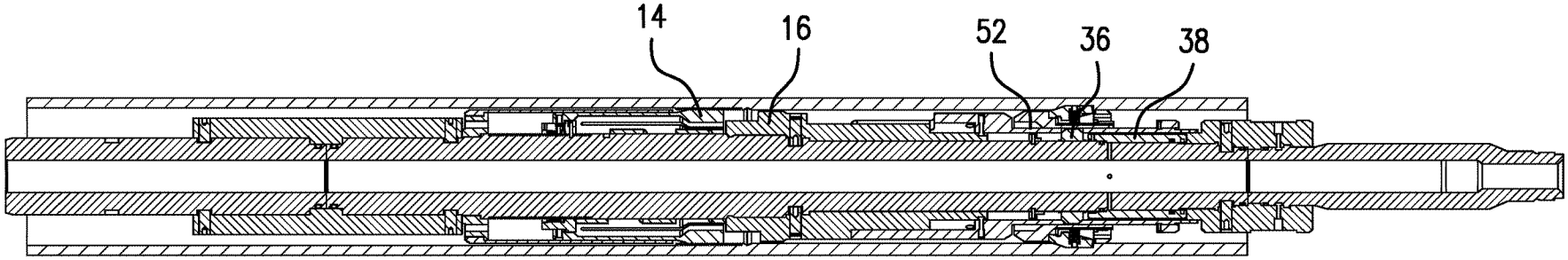
Figure 7D:
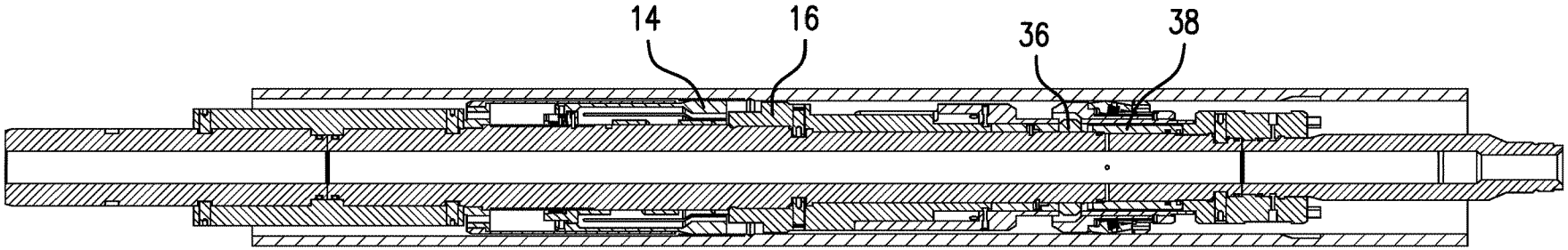

Referring now to FIGS. 7A-7D for context and sequence (and still to FIGS. 1-6 for detail), the release operation is illustrated. In FIG. 7A, the tool 10 is illustrated in the engaged position in tubular 20. It will be appreciated that the thread engager 14 has been threaded into thread 24 and the torque dog 34 has been received in recess 44. In this condition, as noted above, the tubular 20 and anything connected thereto is runnable through a tortuous path of a borehole using axial manipulation from push and pull and rotational torque. Once the tubular 20 (liner hanger, liner itself, setting tubular, etc.) is to depth, operations such as cementing can commence if needed. At the conclusion of such operations the running tool 10 must be release from tubular 20. As noted above, there is both a hydraulic and a mechanical release method for tool 10. FIGS. 7A-7D are directed to illustrating the sequence for hydraulic release. Moving to FIG. 7B, the first stage of release is illustrated. The lock dog sleeve 38 is illustrated having moved downhole from its position in FIG. 7A. This is due to hydraulic pressure being raised in the ID of the mandrel 12. Pressure is supplied for this movement through port 50. The pressure up is occasioned by any number of closures of the ID of the liner being installed. Could be a dedicated plug or a cement plug landing at a cement shoe, etc. Once the sleeve 38 is moved to the position shown in FIG. 7B, the lock dog 36 is free to drop radially inwardly away from shoulder 52. The lock dog 36 then moves along with the profile portion 42 of the torque dog sub 18 and the support 16 in the downhole direction. Consequently, the engager 14 is unsupported by support 16. This can be seen in FIG. 7C. The engager 14 will either move radially inwardly on its own due to a bias of the engager 14 radially inwardly or may move based upon being forced to slide under protector sleeve 32. The force for this movement is supplied by the biaser 28, which in an embodiment is a compression spring that is installed in a compressed state and held there with a body lock ring 29 and a release member 30. It should be noted that the biaser 28 may be used with either the nonbiased engager or with the biased engager as an auxiliary impetus to deflect radially inwardly and out of engagement with the thread 24. Once the release member 30 is released, the spring force is free to push the engager 14 away from the support 16 and under the protector sleeve 32. FIG. 4 makes the action of the engager 14 and sleeve 32 clearer. The illustration shows the engager having a ramp 54 and the sleeve 32 having a chamfer 56. In the condition as described, which is shown in FIG. 7D, and because of the chamfer 48 that allows the torque dog 34 to be removed from the recess 44 by a pull, the tool 10 is no longer secured in tubular 20 and may be relocated out of the tubular such as retrieved to surface.

Figure 8A:
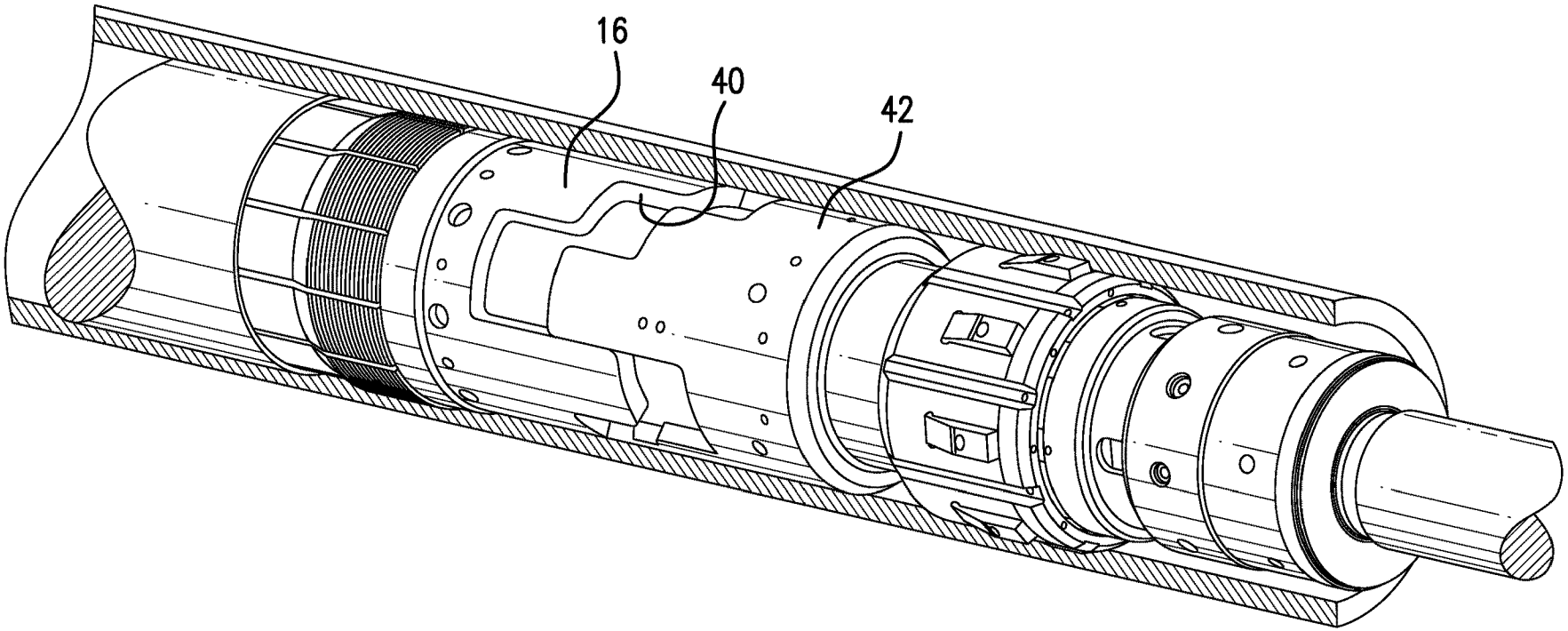
FIGS. 8A and 8B are sequential views along with FIG. 1 illustrating a mechanical release of the tool.
Figure 8B:
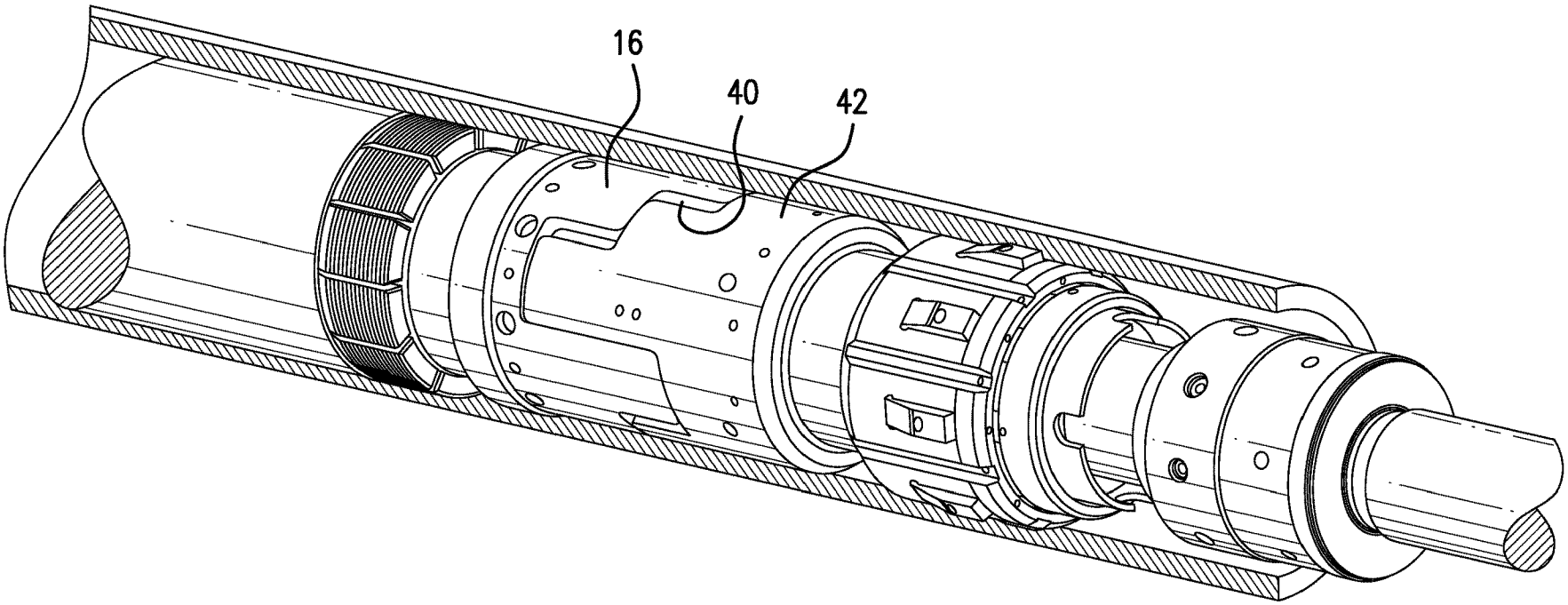
Figure 9A:
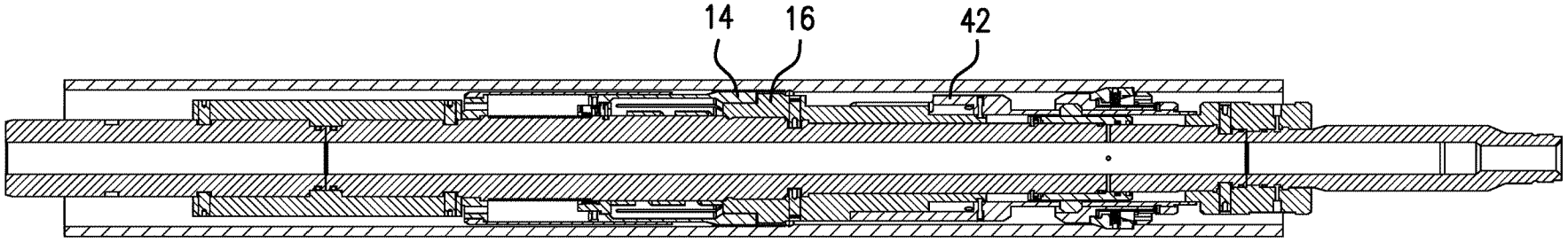
FIGS. 9A-9D are sequential views of the mechanical release of the tool.
Figure 9B:
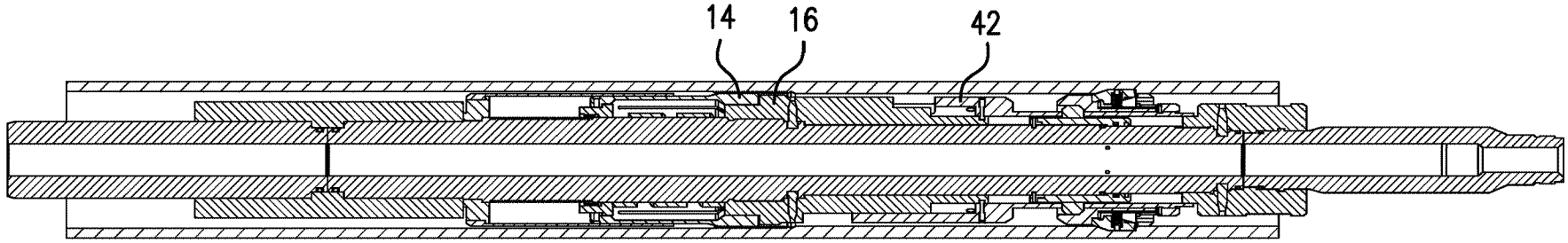
Figure 9C:
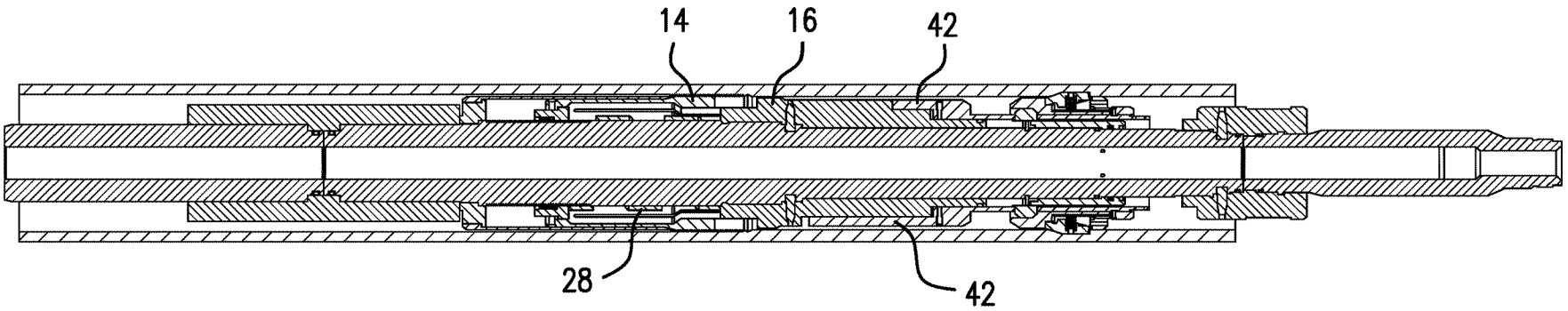
Figure 9D:
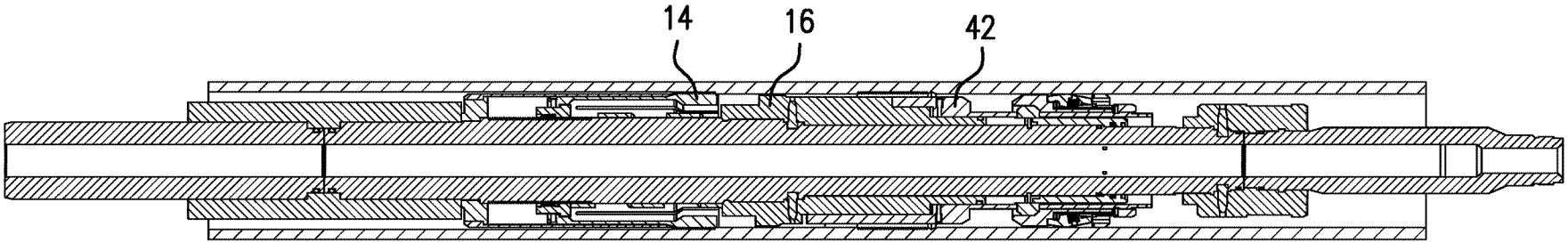

In the event that the hydraulic release is not available, has failed, or simply because it is desirable to eschew the hydraulic function of tool 10 in a particular situation, the tool 10 may also be mechanically released from tubular 20. The process is illustrated through a combination of FIGS. 1, 8A and 8B, and FIGS. 9A-9D. Initially, FIGS. 1, 8A and 8B are references sequentially to note the positions of the support 16 relative to the profile portion 42. In FIG. 1, the two components are in an initial position. In FIG. 8A, it will be perceived that the support 16 has rotated left (when viewed from the uphole (left of Figure) end. This is consequent to imposing left hand torque on the string (not shown) to which the tool 10 is attached. The torque dog sub will not rotate due to the engagement of the torque dog 34 in recess 44 and so only the support 16 will rotate. In FIG. 8A, the rotation is complete and it can be appreciated that the longitudinal extent of support 16 and profile portion 42 are able in this position to collapse to a smaller longitudinal dimension. The smaller dimension is illustrated in FIG. 8B. The position shown in FIG. 8B aligns with FIG. 9C. It will be appreciated that the reduction in length of support 16 and profile portion 42 are sufficient to allow support 16 to unsupport engager 14 just like it was unsupported in the hydraulic operation but without the need for the sleeve 38 to unsupport lock dog 36. In this position the disengagement of the engager 14 is identical to the discussion in FIGS. 7A-7D and so it will be omitted here. A pull uphole will relocate the tool 10 out of the tubular 20 and may include retrieval to surface as shown in FIG. 9D.

Figure 10:
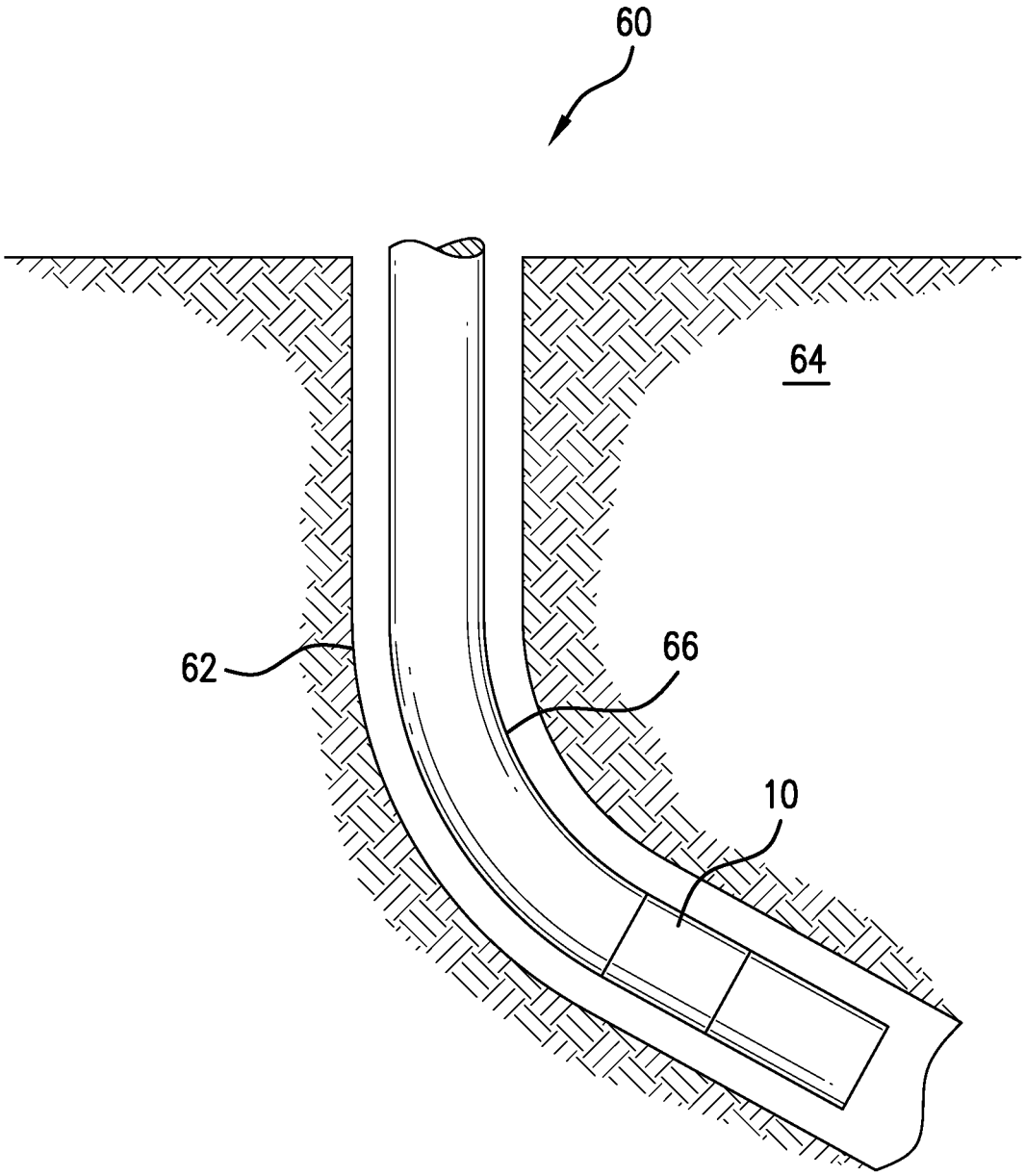
FIG. 10 is a view of a borehole system including the tool as disclosed herein.

Referring to FIG. 10, a borehole system 60 is illustrated. The system 60 comprises a borehole 62 in a subsurface formation 64. A liner system 66 is disposed within the borehole 62, the liner system including the running tool 10 as disclosed herein.

Set forth below are some embodiments of the foregoing disclosure:

Embodiment 1: A running tool including a mandrel, a thread engager disposed upon the mandrel, a support supporting the thread engager in a first position and unsupporting the thread engager in a second position, and a torque dog sub including a torque dog, a lock dog, and lock dog sleeve disposed on the mandrel.

Embodiment 2: The tool as in any prior embodiment, wherein the thread engager is in the form of a collet.

Embodiment 3: The tool as in any prior embodiment, wherein the collet is radially inwardly biased.

Embodiment 4: The tool as in any prior embodiment, wherein the collet is non biased.

Embodiment 5: The tool as in any prior embodiment, further comprising a protector sleeve disposed radially outwardly of the thread engager and configured to cause radially inward deflection of the thread engager upon relative movement thereof.

Embodiment 6: The tool as in any prior embodiment, wherein the protector sleeve incudes a chamfer to contact the thread engager.

Embodiment 7: The tool as in any prior embodiment, further including a biaser in contact with the thread engager that urges, when released, the thread engager in a longitudinal direction relative to a longitudinal length of the tool.

Embodiment 8: The tool as in any prior embodiment, wherein the support further includes a rotational drive and longitudinal movement profile thereon.

Embodiment 9: The tool as in any prior embodiment, wherein the lock dog sleeve is responsive to hydraulic pressure to unsupport the lock dog.

Embodiment 10: The tool as in any prior embodiment, wherein the torque dog is engageable with a radially outwardly disposed tubular.

Embodiment 11: The tool as in any prior embodiment, wherein the torque dog is engageable with a recess in the tubular.

Embodiment 12: A liner system including a liner system component, a running tool as in any prior embodiment engaged with the liner component.

Embodiment 13: The system as in any prior embodiment wherein the liner system component is a liner hanger, a setting tubular, or a liner.

Embodiment 14: A borehole system including a borehole in a subsurface formation, and a liner system as in any prior embodiment in the borehole.

Embodiment 15: A method for releasing a liner including pressuring up on the running tool as in any prior embodiment, shifting the lock dog sleeve, and slacking weight to shift the support.

Embodiment 16: The method as in any prior embodiment, further including driving the thread engager into a protector sleeve with a biaser.

Embodiment 17: A method for releasing a liner including applying neutral set down weight to the running tool as in any prior embodiment, rotating the support, slacking weight to shift the support, and moving the tool out of engagement with the liner.

Embodiment 18: The method as in any prior embodiment wherein the moving further includes radially inwardly deflecting the torque dog.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of values up to ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A running tool comprising:
a mandrel;
a thread engager disposed upon the mandrel;
a support supporting the thread engager in a first position and unsupporting the thread engager in a second position;
a torque dog sub including a torque dog, a lock dog, and lock dog sleeve disposed on the mandrel; and
a protector sleeve disposed radially outwardly of the thread engager and configured to cause radially inward deflection of the thread engager upon relative movement thereof.

2. The tool as claimed in claim 1, wherein the thread engager is in the form of a collet.

3. The tool as claimed in claim 2, wherein the collet is radially inwardly biased.

4. The tool as claimed in claim 2, wherein the collet is non biased.

5. The tool as claimed in claim 1, wherein the protector sleeve incudes a chamfer to contact the thread engager.

6. The tool as claimed in claim 1, further including a biaser in contact with the thread engager that urges, when released, the thread engager in a longitudinal direction relative to a longitudinal length of the tool.

7. The tool as claimed in claim 1, wherein the support further includes a rotational drive and longitudinal movement profile thereon.

8. The tool as claimed in claim 1, wherein the lock dog sleeve is responsive to hydraulic pressure to unsupport the lock dog.

9. The tool as claimed in claim 1, wherein the torque dog is engageable with a radially outwardly disposed tubular.

10. The tool as claimed in claim 9, wherein the torque dog is engageable with a recess in the tubular.

11. A liner system comprising:
a liner system component;
the running tool as claimed in claim 1 engaged with the liner component.

12. The system as claimed in claim 11 wherein the liner system component is a liner hanger, a setting tubular, or a liner.

13. A borehole system comprising:
a borehole in a subsurface formation; and
the liner system as claimed in claim 11 in the borehole.

14. A method for releasing a liner comprising:
pressuring up on a running tool comprising:
a mandrel;
a thread engager disposed upon the mandrel;
a support supporting the thread engager in a first position and unsupporting the thread engager in a second position; and
a torque dog sub including a torque dog, a lock dog, and lock dog sleeve disposed on the mandrel;
shifting the lock dog sleeve; and
slacking weight to shift the support.

15. The method as claimed in claim 14 further including driving the thread engager into a protector sleeve with a biaser.

16. A method for releasing a liner comprising:
applying neutral set down weight to a running tool comprising:
a mandrel;
a thread engager disposed upon the mandrel;
a support supporting the thread engager in a first position and unsupporting the thread engager in a second position; and a torque dog sub including a torque dog, a lock dog, and lock dog sleeve disposed on the mandrel;

rotating the support;

slacking weight to shift the support; and moving the tool out of engagement with the liner.

17. The method as claimed in claim 16 wherein the moving further includes radially inwardly deflecting the torque dog.

* * * * *